US006273844B1

(12) United States Patent
Kelsey et al.

(10) Patent No.: US 6,273,844 B1
(45) Date of Patent: Aug. 14, 2001

(54) UNLOADING SYSTEM FOR THERAPY, EXERCISE AND TRAINING

(75) Inventors: Douglas D. Kelsey; Gary H. Anders, both of Austin, TX (US)

(73) Assignee: Paradigm Health Systems International, Inc., Metairie, LA (US)

( * ) Notice: Subject to any disclaimer, the term of this patent is extended or adjusted under 35 U.S.C. 154(b) by 0 days.

(21) Appl. No.: 09/648,223

(22) Filed: Aug. 25, 2000

(51) Int. Cl.[7] ..... A63B 22/00
(52) U.S. Cl. ..... 482/54; 482/69
(58) Field of Search ..... 482/54, 69, 74, 482/71, 51, 55, 112, 66, 68, 7; 119/700, 712; 434/247, 255

(56) References Cited

U.S. PATENT DOCUMENTS

| | | | |
|---|---|---|---|
| 2,327,671 | | 8/1943 | Ruprecht . |
| 2,625,202 | | 1/1953 | Richardson et al. . |
| 2,903,238 | | 9/1959 | Flandrick . |
| 3,252,704 | | 5/1966 | Wilson . |
| 3,568,226 | | 3/1971 | Mater et al. . |
| 3,621,819 | | 11/1971 | Hooper . |
| 3,721,437 | * | 3/1973 | Skaricic ..... 272/70.3 |
| 3,730,587 | | 5/1973 | Bloxham et al. . |
| 3,761,082 | | 9/1973 | Barthel, Jr. . |
| 4,410,175 | | 10/1983 | Shamp . |
| 4,449,716 | | 5/1984 | Goldy et al. . |
| 4,571,785 | | 2/1986 | Samuelsson . |
| 4,607,724 | | 8/1986 | Hillberg . |
| 4,790,410 | | 12/1988 | Sharp et al. . |
| 4,973,044 | | 11/1990 | Jones . |
| 5,050,590 | | 9/1991 | Futakami . |
| 5,190,507 | | 3/1993 | Iijima . |
| 5,201,693 | | 4/1993 | Sparkes . |
| 5,273,502 | | 12/1993 | Kelsey et al. . |
| 5,322,409 | | 6/1994 | McCluney . |
| 5,456,655 | | 10/1995 | Morris . |
| 5,458,550 | | 10/1995 | Brain et al. . |
| 5,526,893 | | 6/1996 | Higer . |
| 5,569,129 | | 10/1996 | Seik-Naraghi et al. . |
| 5,577,984 | | 11/1996 | Bare, II . |
| 5,601,434 | | 2/1997 | Winters . |
| 5,601,527 | | 2/1997 | Selfowitz . |
| 5,603,677 | | 2/1997 | Sollo . |
| 5,623,948 | | 4/1997 | Morris . |
| 5,626,540 | | 5/1997 | Hall . |
| 5,662,560 | | 9/1997 | Svendsen et al. . |
| 5,695,432 | | 12/1997 | Söderlund . |
| 5,772,622 | | 6/1998 | Friske . |
| 5,830,162 | | 11/1998 | Giovannetti . |

FOREIGN PATENT DOCUMENTS

| | | |
|---|---|---|
| 87309987.3 | 11/1987 | (EP) . |
| 88103010.0 | 2/1988 | (EP) . |
| 2 252 108 | 11/1973 | (FR) . |
| PCT/SE85/00201 | 5/1985 | (WO) . |

* cited by examiner

*Primary Examiner*—Stephen R. Crow
(74) *Attorney, Agent, or Firm*—Fellers, Snider, Blankenship, Bailey & Tippens

(57) ABSTRACT

An apparatus for unloading a user's body weight during physical activity comprising: a frame; a pair of straight springs pivotably extending from an upper portion of the frame and having distal ends spaced apart from each other; and a fluid-operated lift system for raising the distal ends of the straight springs to provide a lifting force for the user.

9 Claims, 7 Drawing Sheets

UNLOADING SYSTEM FOR THERAPY, EXERCISE AND TRAINING

FIELD OF THE INVENTION

The present invention relates to apparatuses and methods for unloading or supporting a portion of a person's body weight during therapy, exercise, or athletic training.

BACKGROUND OF THE INVENTION

In order to facilitate and accelerate many physical rehabilitation processes, it is best to incorporate functionally oriented, task-specific exercises and movements into the rehabilitation program. For example, when it is desired that a patient recovering from a knee, leg or ankle injury be able to resume walking, running, squatting as soon as possible, the rehabilitation program will preferably include walking, rnmning, or squatting movements. Unfortunately, unless a portion of the patient's body weight is somehow "unloaded" from the injured knee, leg, ankle, or other weight-bearing member, the patient often will not be able to engage in such task-specific movements and activities without pain and/or possible additional injury.

As used in the art, the term "unloading" refers to exercise, therapeutic rehabilitation, and athletic training techniques wherein, while performing beneficial exercises and movements, a portion of the person's body weight is continuously unloaded (relieved) from the weight-bearing parts of the person's body. If, for example, a patient recovering from knee surgery weighs 150 pounds but is only capable of bearing a standing body weight of 50 pounds, the patient will not be able to exercise in a standing position unless at least 100 pounds of the patient's body weight are somehow continuously unloaded/relieved from the person's knees throughout the activity in question. Stated another way, at least 100 pounds of the patient's body weight must be lifted and supported in such a manner that the patient's knees are required to bear no more than 50 pounds of the patient's body weight during the exercise activity.

In the context of physical therapy, the ability to reliably, precisely and continuously unload a portion of the patient's body weight is particularly desirable in situations where, for example: (a) fall weight-bearing is painful to such a degree that the patient's ability to engage in task-specific, functional activity is significantly limited; (b) due to muscular weakness, impairment of balance, and/or proprioception, functional movements are essentially impossible without physical assistance; and/or (c) the patient's general fitness condition is such that necessary movement and exercise is overly fatiguing.

In the context of aerobic exercise and athletic training, unloading techniques can be used to: maintain a targeted heart rate over a substantial period of time; reduce stress and impact on the person's limbs and joints; improve reflexes, reaction times and quickness; and reduce injuries, both on and off the field. Over-speed training, for example, conducted under unloaded conditions can be used to improve an athlete's coordination when moving at top speeds.

The concept of reducing the effects of body weight and gravity during rehabilitation and training is familiar to most athletic trainers, physical therapists, and other health-care practitioners. Aquatic therapy is often prescribed, for example, for patients with back or other injuries. Unfortunately, aquatic therapy has significant shortcomings in that (a) it is typically not possible to precisely control the amount of weight unloaded from the patient and (b) it is typically not possible, when immersed in water, to practice task-specific movements at normal or accelerated speed.

Various types of devices for unloading body weight while walking, jogging, or running on treadmills, or while engaging in other exercises, are known in the art. As on example, French patent publication 2,252,108 discloses a cable and pulley arrangement wherein a pneumatic cylinder is used to provide and adjust the lifting force imparted to the user. As another example, U.S. Pat. No. 3,761,082 discloses a harness assembly for stationary exercise and walking wherein a short, overhead tension spring is used to "counterbalance" a portion of the user's weight.

Unfortunately, common unloading systems utilizing air or gas cylinders, hydraulic cylinders, or springs have significant shortcomings. When walking or running on a treadmill, a person's torso repeatedly moves up and down (oscillates) as much as three inches or more. The rate of oscillation increases significantly as the exercise speed proceeds from walking to jogging to running. The air, gas, or hydraulic cylinder systems known heretofore have typically been capable of accommodating relatively low oscillation speeds such as occur when the person is walking at a speed of less than two miles per hour. However these prior systems cannot respond quickly enough to accommodate higher oscillation rates such as occur when jogging or running. Thus, when exercising at higher speeds, the user will experience abrupt jolts and jerking forces which are uncomfortable and can potentially cause significant harm.

In contrast to the common systems utilizing air, gas, or hydraulic cylinders, spring devices such as the one disclosed in U.S. Pat. No. 3,761,082 are capable of responding to both low and high frequency oscillations. Unfortunately, however, the amount of lifting force imparted by a spring of the type employed in U.S. Pat. No. 3,761,082 changes tremendously as the spring stretches and contracts over the normal oscillation range. Thus, rather than providing a desirably constant unloading force, the spring will typically provide a greatly exaggerated lifting force when the torso is positioned at the bottom of the oscillation interval but may provide almost no lifting force when the torso is positioned at the upper end of the oscillation interval.

In comparison to the devices just described, a greatly improved therapeutic unloading system is disclosed in U.S. Pat. No. 5,273,502. The improved system comprises: a frame; an electrical winch and associated load cell mounted at the bottom of the frame; a relatively long, low constant spring positioned within a vertical side rail of the frame; a first cable segment extending from the winch to the lower end of the spring; and a second segment of cable having one end secured to the top of the spring and a second end extending downwardly from the top of the frame for attachment to a harness. The control circuitry of the improved device continuously monitors the unloading force acting on the patient and causes the winch to respond automatically to changes in the patient's position. The winch is fast acting so that it reacts very quickly. Moreover, the spring employed in the improved device compliments the winch system and assists in maintaining a more constant unloading force. In contrast to the springs used in other systems, the spring employed in the improved system is relatively long (typically about three feet in length prior to stretching) and has a low spring constant value such that it must be stretched a significant distance (possible up to twice its original length or more) when initially setting the desired unloading force to be applied to the patient. As a result, the spring is able to absorb and dampen small positional movements, regardless of speed, such that no significant change in the total applied unloading force occurs.

Although highly effective for absorbing and dampening small oscillations and movements, regardless of speed, the use of a long, low constant spring can limit the adaptability, size and/or uses of a system of the type disclosed in U.S. Pat. No. 5,273,502. As the required amount of unloading force increases, the spring must be stretched to a greater and greater degree. However, as the height of the user increases, the maximum available length to which the spring can be stretched decreases. Thus, for a very tall user, the amount of unloading force obtainable may be significantly limited. Although the apparatus can certainly be enlarged to accommodate the taller user, the larger apparatus may not function as well for smaller users and could be too large to fit within the particular room and/or ceiling space available.

Thus, a need exists for an unloading system which is at least as effective as the system of U.S. Pat. No. 5,273,502 and overcomes its limitations. Of course, any further improvement in the responsiveness of the unloading system and/or the ability, regardless of the speed, to maintain a constant unloading force would also be desirable and beneficial.

SUMMARY OF THE INVENTION

The present invention provides an unloading system which satisfies the needs and overcomes the limitations discussed above. The inventive system easily accommodates taller users, can fit under an eight foot ceiling without any loss of unloading capacity, accommodates wide oscillations and movements at substantially any speed, provides a highly desirable, uniform, constant unloading force, can precisely identify and target the user's weight-bearing capacity, and allows the unloading force to be easily adjusted, even while the user exercises. The inventive system also permits the unloading force to be applied either at a single point or at two points (e.g., over each of the user's shoulders). Dividing the unloading force in this manner can be beneficial for certain orthopedic or neurological conditions. Further, the inventive system does not utilize any cable operating devices and therefore eliminates certain maintenance requirements.

The present invention provides an apparatus for unloading a user's body weight during physical activity comprising: a frame; at least one straight spring pivotably extending from the frame; and a fluid-operated means for raising the distal end of said straight spring to provide a lifting force for the user. The fluid-operated means for raising the distal end of the straight spring is preferably a compressed air lifting means. The inventive apparatus preferably comprises two straight springs, the distal ends of which are spaced apart from each other.

The inventive unloading system can be used in combination with treadmills, stationary bicycles, ski simulators, and other equipment for exercise, athletic training, or physical therapy.

Further objects, features, and advantages of the present invention will be apparent upon examining the accompanying drawings and upon reading the following description of the preferred embodiments.

DETAILED DESCRIPTION OF THE PREFERRED EMBODIMENTS

Figure 1:
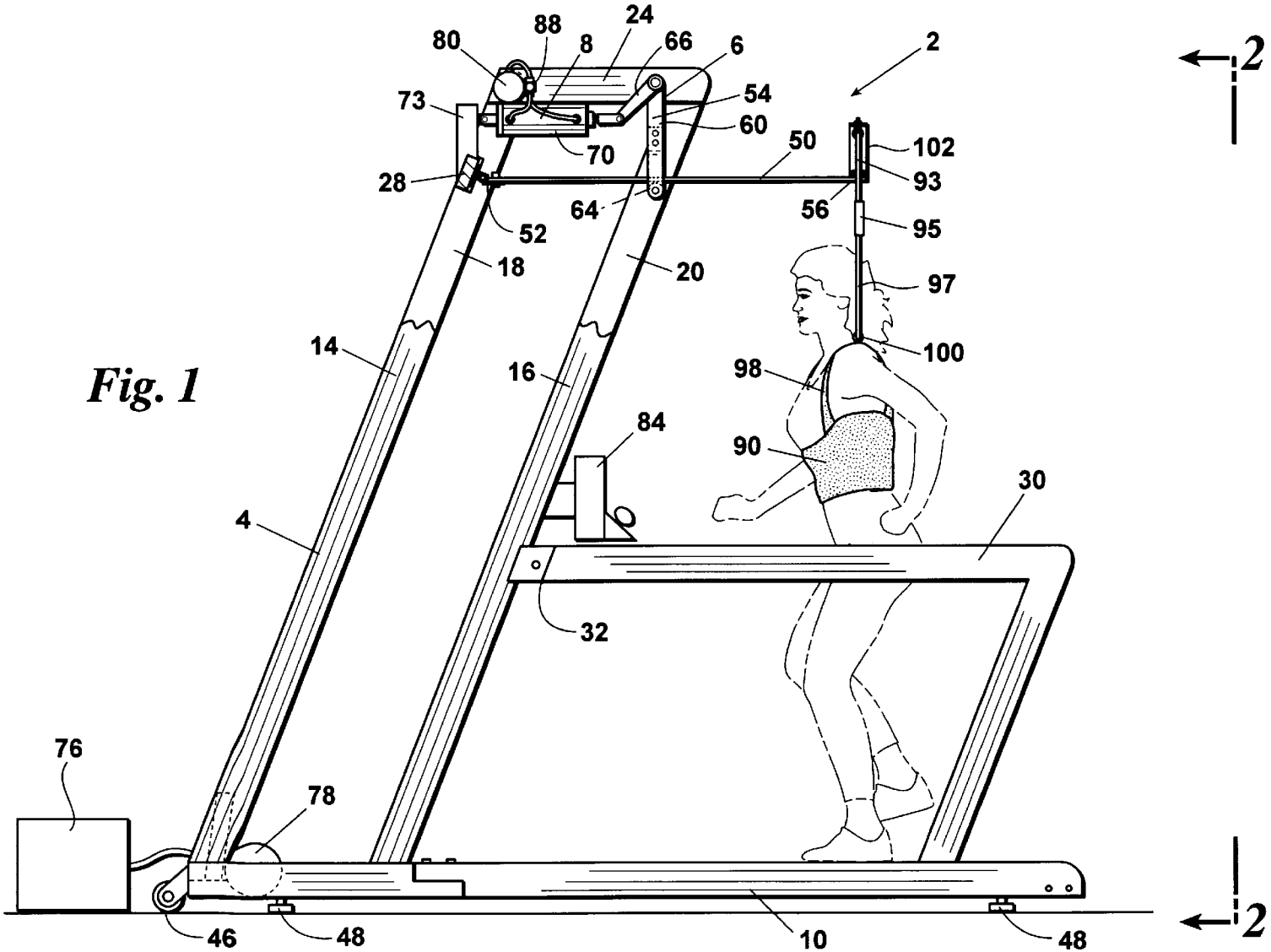
FIG. 1 provides a partially cutaway elevational side view of an embodiment 2 of the inventive unloading apparatus.

An embodiment 2 of the inventive unloading apparatus is depicted in FIGS. 1–6 and 8. Inventive apparatus 2 comprises: a frame structure 4; a spring suspension assembly 6; and a lift power system 8. Although generally any type of lift power system can be used, lift system 8 is preferably a fluid-type lift system (e.g., an air, gas, or hydraulic system) and is most preferably a compressed air system.

Frame 4 preferably comprises: a pair of parallel base members 10 and 12; a first pair of parallel side supports 14 and 16 extending upwardly from the forward end of base member 10; a second pair of parallel side supports 18 and 20 extending upwardly from the forward end of base member 12; a first longitudinal support 22 extending between the upper ends of parallel side supports 14 and 16; a second longitudinal support 24 extending between the upper ends of parallel side supports 18 and 20; a lower cross member 26 extending between the lower ends of side supports 14 and 18; an upper cross member 28 extending between the upper ends of side supports 14 and 18; an angled side rail structure 30 extending upwardly from base member 12 and having a forward end 32 connected to side support 16; and a second side rail structure 34 extending upwardly from base member 12 and having a forward end connected to side support 20. Base members 10 and 12, side supports 18 and 20, and side rails 30 and 34 are, of course, spaced apart a sufficient distance for receiving a treadmill, a stationary bike, or other exercise equipment. The parallel upwardly extending side supports 14, 16, 18, and 20 of frame 4 are preferably angled rearwardly as depicted in FIG. 1 at about 70% from horizontal.

Frame 4 can also optionally include casters 46, rotatably secured to the forward end of frame 4, for moving the inventive apparatus. Threadedly adjustable feet 48 or other structures can be used on the bottom of frame 4 to squarely balance the inventive apparatus 2 on the floor.

The spring suspension assembly 6 of inventive apparatus 2 preferably comprises: a pair of parallel straight springs 50 spaced apart a sufficient distance such that the distal ends 56 of springs 50 will be positioned over the user's shoulders; a pair of hinges 52 which pivotably secure the rearward ends of leaf springs 50 to frame 4; and a lift assembly 54 upon which the mid-portions of leaf springs 50 rest. Lift assembly 54 is operated by lift power system 8 for selectively raising and lowering the distal ends 56 of leaf springs 50 as necessary to establish or release the desired unloading force. By way of example but not by way of limitation, straight springs 50 can be leaf-type springs, bar springs or spring rods. Straight springs 50 are preferably flat, leaf springs of the type depicted in FIGS. 1–7 and 9.

Figure 3:
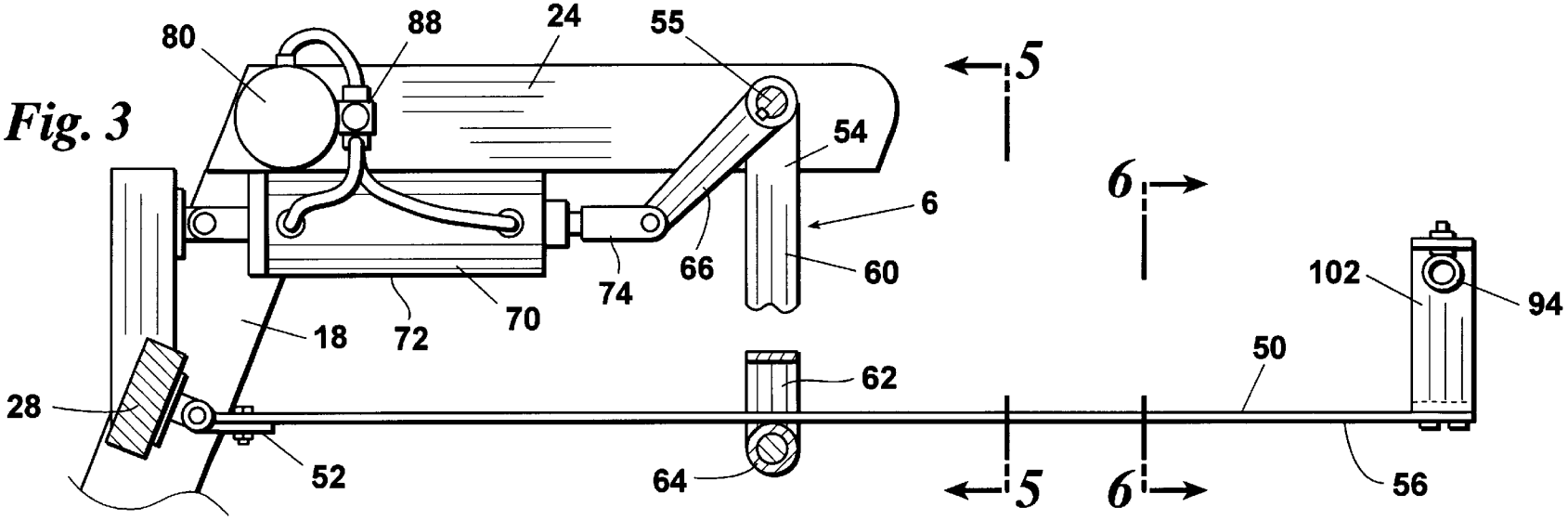
FIG. 3 provides a cutaway elevational side view of a spring suspension assembly 6 and a portion of a lift power system 8 employed in inventive apparatus 2.
Figure 4:
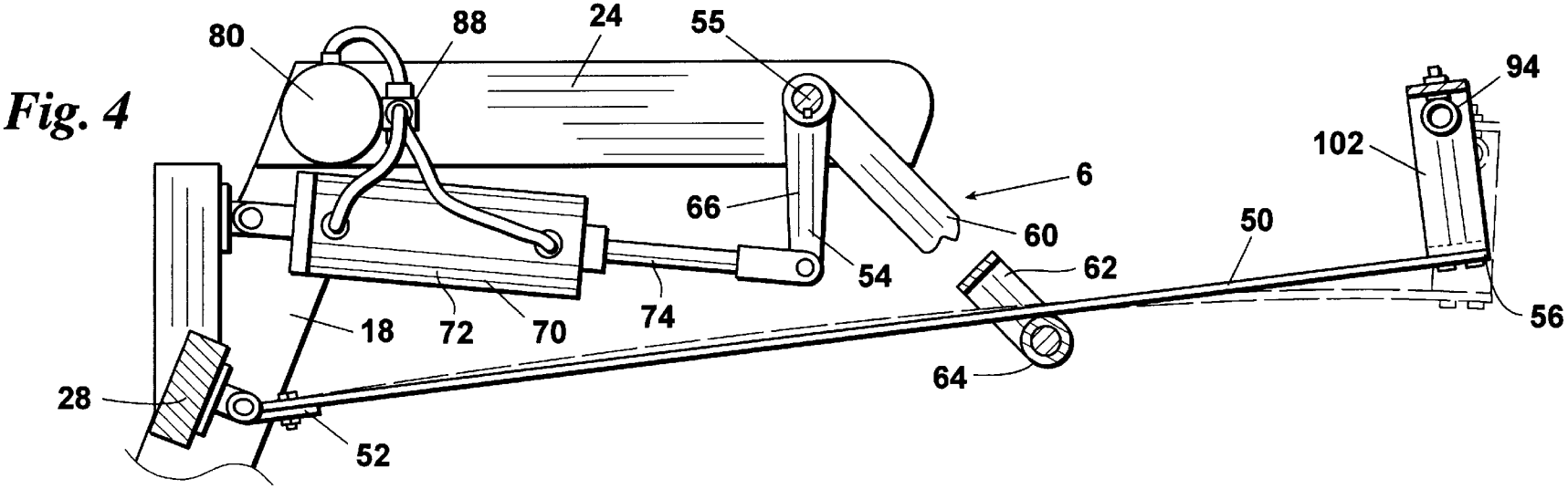
FIG. 4 provides a second cutaway elevational side view corresponding to that of FIG. 3 except that spring suspension assembly 6 is in a lift position.
Figure 5:
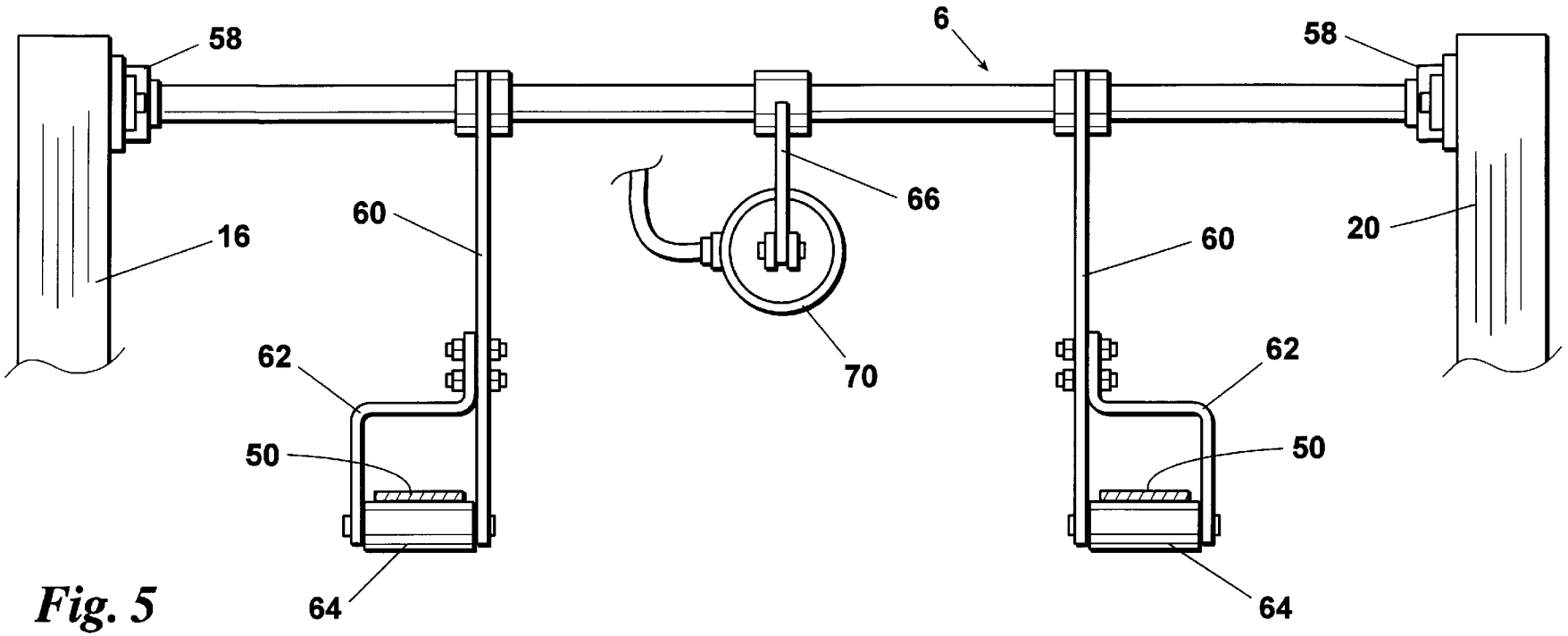
FIG. 5 provides an elevational view of spring suspension assembly 6 as seen from perspective 5—5 shown in FIG. 3.
Figure 6:
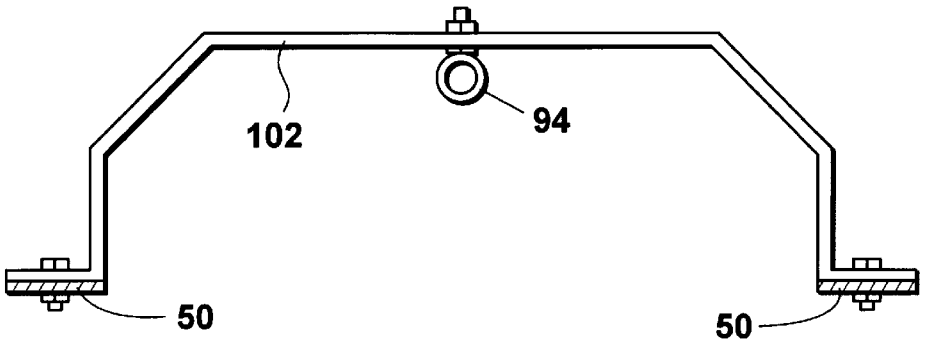
FIG. 6 provides an elevational view of spring suspension assembly 6 as seen from perspective 6—6 shown in FIG. 3.

As will be apparent, the lift assembly 54 could generally be any type of pivotable or raisable structure or assembly capable of supporting and selectively raising and lowering leaf springs 50. Lift assembly 54 preferably comprises: a lateral shaft 55, the ends of which are rotatably received in bearings, bushings, or other friction-reducing members 58 installed in or on the upper longitudinal supports 22 and 24 of frame 4; a pair of lift arms 60 extending downwardly from lateral shaft 55 and having stirrups 62 formed in the lower ends thereof for receiving leaf springs 50; and rollers 64 rotatably secured in the bottoms of stirrups 62. Lift assembly 54 also includes a tongue member 66 to which the lift power system 8 is linked for pivoting lift assembly 54 about the longitudinal axis of lateral shaft 55. To facilitate the lifting operation of assembly 54, tongue 66 preferably extends from the center of lateral shaft 55 at an angle (preferably about 45°), as shown in FIGS. 1, 3, and 4, with respect to lift arms 60.

Lift power system 8 preferably comprises: a pneumatic ram 70 having (a) a housing 72 pivotably connected to a vertical support 73 extending upwardly from upper frame cross member 28 and (b) a piston 74 pivotably connected to the tongue 66 of lift assembly 54; an oil-free air compressor 76; a high pressure tank 78, preferably secured in the lower rearward end of frame 4, which receives compressed air directly from compressor 76; an air hose or other conduit 77 extending between compressor 76 and high pressure tank 78; a regulated pressure tank 80 preferably secured between upper frame members 22 and 24; an air hose or other conduit 82 extending from high pressure tank 78 to regulated pressure tank 80; a pressure regulator 84, installed in air conduit 82, for selectively maintaining a desired lifting pressure in regulated pressure tank 80; a sensor and associated gauge 86, digital indicator, or other indicating device for determining and indicating the unloading force applied by the inventive system based upon the pressure in regulated tank 80; and a valve 88 and tubing assembly, connected between regulated tank 80 and pneumatic ram 70, for selectively applying and releasing lifting pressure to and from ram 70.

As will be understood by those skilled in the art, the inventive apparatus also includes appropriate pressure sensors and controls (not shown) for automatically starting and stopping compressor 76 as necessary to maintain an air source pressure in high pressure tank 78 preferably in the range of from about 70 to about 120 psi.

Valve 88 is preferably a four-way valve of a type known in the art having a spring return and an electric pilot. When the user activates the lift control, the pilot is energized to shift the valve such that a proper lifting pressure from regulated tank 80 is applied to pneumatic ram 70. When this lifting pressure is applied to ram 70, the ram piston 76 extends forwardly to thereby pivot the lift arms 60 and stirrups 62 of lift assembly 54 upward. As stirrups 62 pivot upward in this manner, the stirrup rollers 64 roll forwardly beneath leaf springs 50, thus raising the distal ends 56 of the springs 50 to lift (i.e., "unload") the user.

Figure 2:
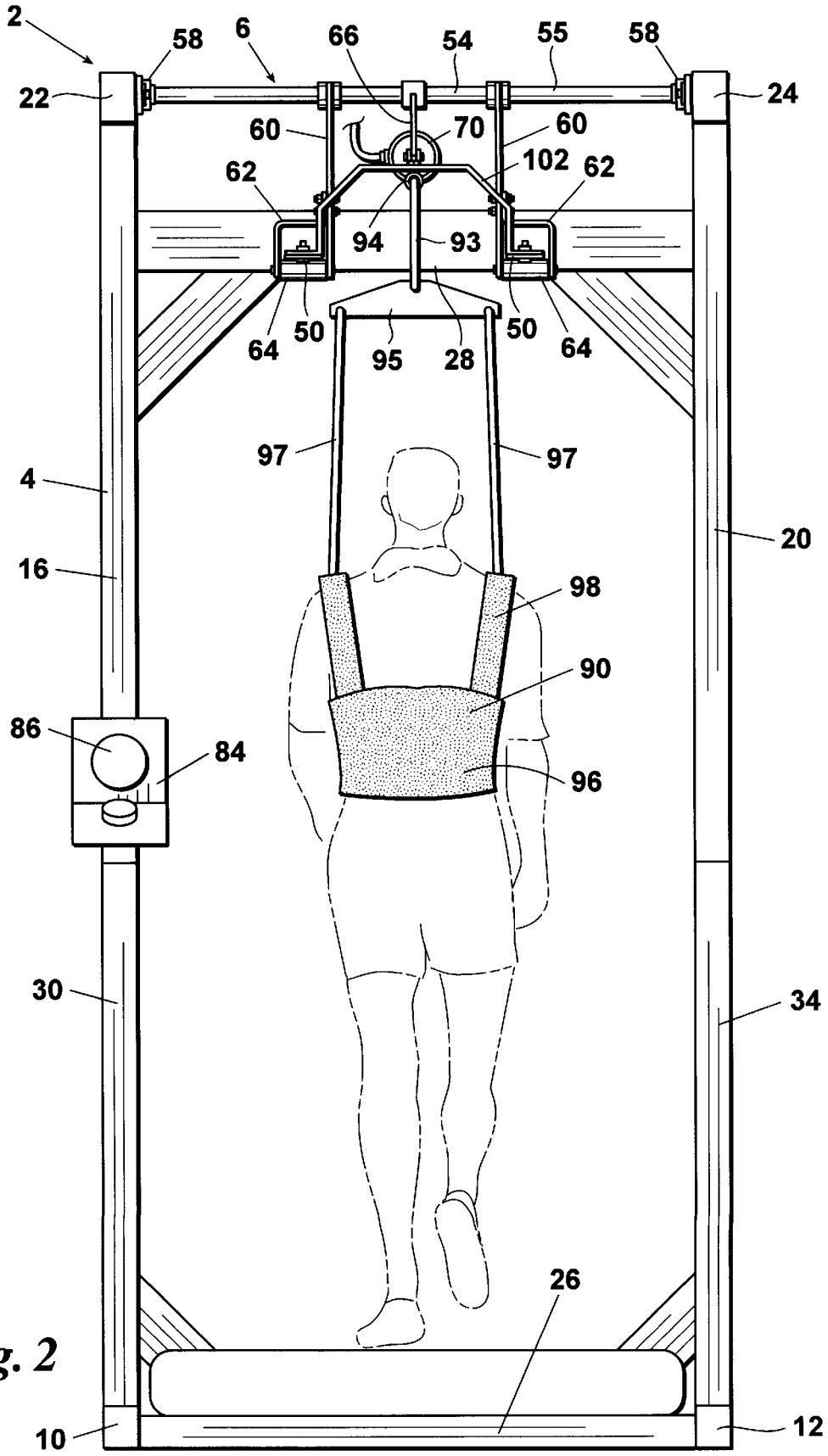
FIG. 2 provides an elevational back view of inventive apparatus 2.

The regulator 84 and lift gauge 86 of lift power system 8 are preferably mounted on frame 4 as shown in FIGS. 1 and 2, such that the patient or user can easily monitor and adjust the unloading force even while exercising.

Inventive apparatus 2 further comprises: a lateral crown or yoke 102 attached to and extending between the distal ends 56 of leaf springs 50; a swivel mounted cable 93 suspended from the center of yoke 102; a harness bar 95 attached to the lower end of cable 93; a pair of cables 97 hanging from the outer ends of harness bar 95; and a body harness 90. Although generally any type of harness, vest, or other device can be used, harness 90 will preferably comprise a chest or abdominal belt 96 having shoulder loops or straps 98 extending therefrom. Eyelets 100 or other structures are provided at the tops of shoulder straps 98 for connecting the distal ends of cables 97 thereto.

Figure 9:
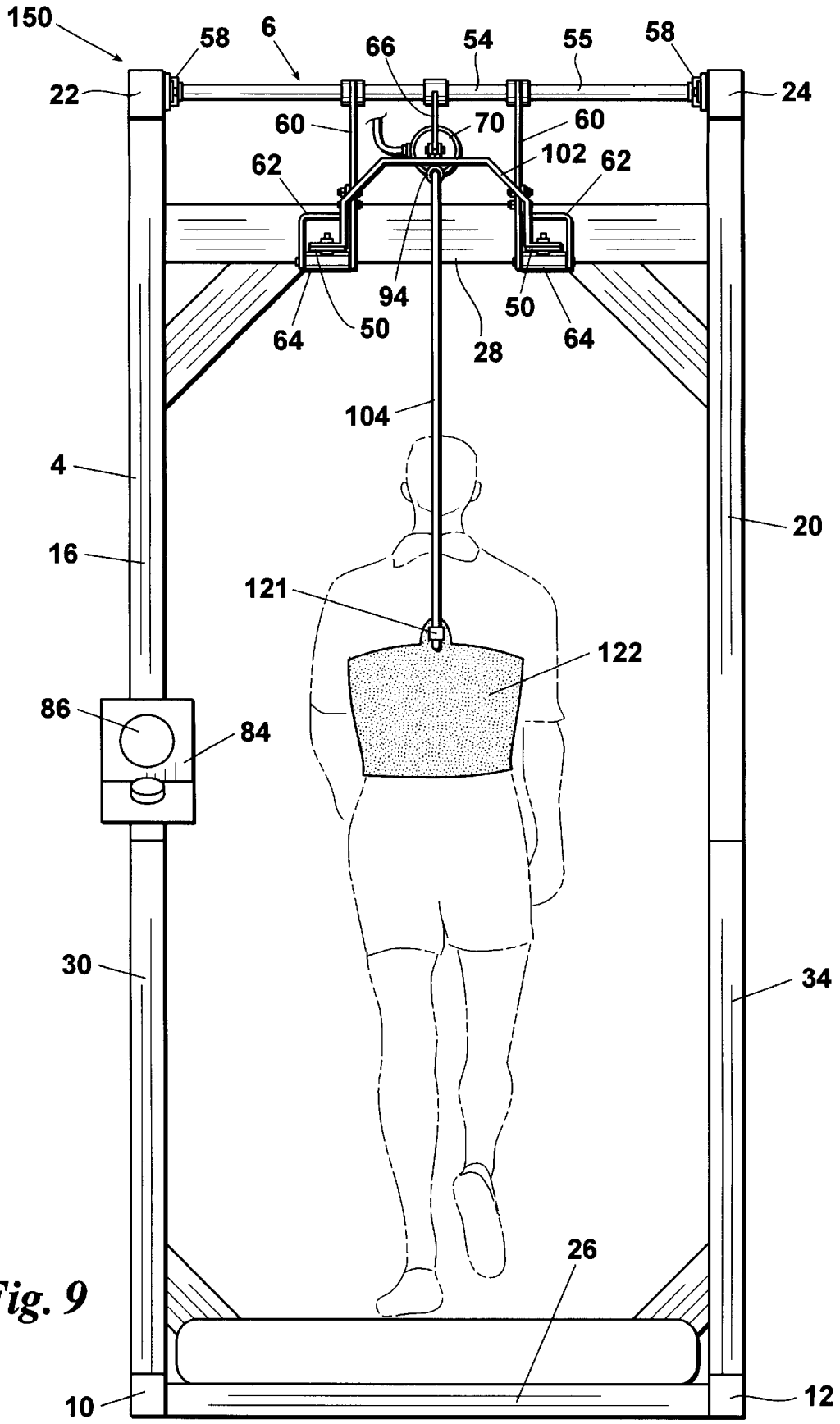
FIG. 9 provides an elevational back view of an alternative embodiment 150 of the inventive unloading apparatus.

In an alternative embodiment 150 depicted in FIG. 9, a single swivel-mounted cable 104 hanging from the center of yoke 102 attaches at one point 121 (preferably on the back of) a body harness 122.

Figure 7:
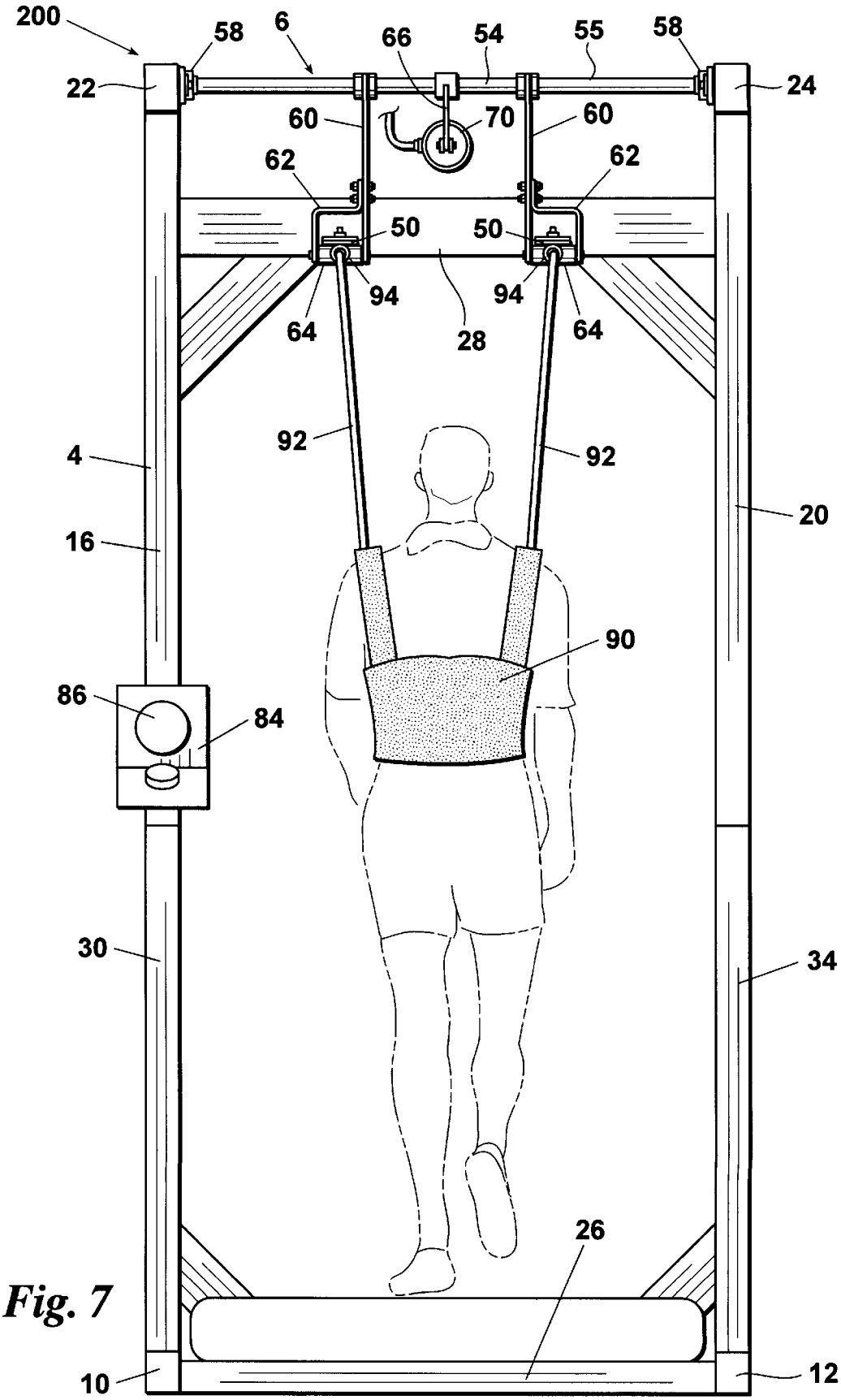
FIG. 7 provides an elevational back view of an alternative embodiment 200 of the inventive unloading apparatus.
Figure 8:
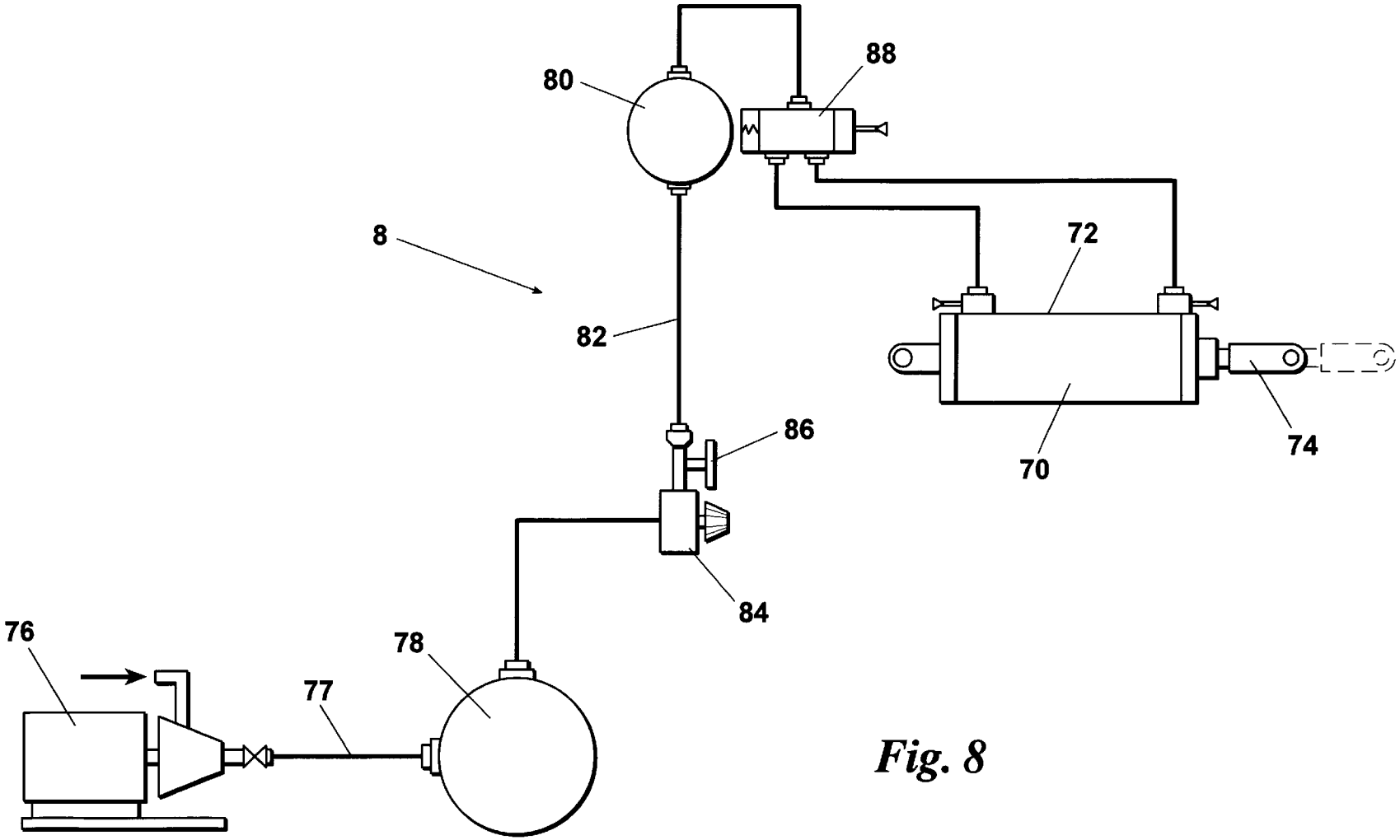
FIG. 8 schematically illustrates lift power system 8.

In another alternative embodiment 200 depicted in FIG. 7, the inventive apparatus includes a body harness 90 suspended directly from the distal ends 56 of leaf springs 50 by a pair of cables 92. Cables 92 are preferably secured to springs 50 using eyelets or similar structures 94.

In each of these embodiments, the eyelets 94 provided on leaf springs 50 or yoke 102 are preferably bearing mounted connectors of a type known in the art which incorporate universal-type joints. The eyelet structures 94 are thus better able to operate at various angles caused by independent deflection of leaf springs 50.

Because it is a fluid-operated (preferably pneumatic) system, lift power system 8 can precisely establish a desired unloading force. As explained above, lift system 8 pivots the lifting assembly 54 upward, which in turn raises the distal ends 56 of leaf springs 50, until an appropriate amount of lifting tension is applied to harness 90 via cable(s) 92 or 104. The amount of lifting tension applied to harness 90 can be precisely determined and controlled by regulating the pressure in regulated tank 80. Moreover, valve 88 operates such that, as lifting pressure is being applied and/or maintained in pneumatic ram 70, ram 70 is kept in fluid communication with regulated tank 80, thus significantly increasing the available effective volume on the high pressure side of ram 70. As a result, small, instantaneous changes in the position of ram piston 74 will not cause any significant spikes in cylinder pressure. Thus, in contrast to most of the compressed air systems used heretofore, the lift system 8 employed in inventive apparatus 2 is significantly more effective for accommodating oscillations and movements, regardless of speed, and maintaining a much more constant unloading force.

As with the spring employed in the unloading apparatus of U.S. Pat. No. 5,273,502, the straight springs 50 of the inventive apparatus absorb smaller oscillations and movements, regardless of speed, and thus further enhance the ability of the inventive system to provide an extremely smooth lift and a constant, smooth unloading force. The inventive system is thus highly responsive and minimizes stress and trauma for the user. Moreover, because they are substantially horizontal, straight springs 50 do not affect, in any significant way, the necessary height of the inventive apparatus. The inventive apparatus will therefore fit within substantially any common ceiling space.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. An apparatus for unloading a user's body weight during physical activity comprising:

a frame;

a straight spring pivotably extending from said frame and having a distal end; and a fluid-operated lifting movably and operatively contacting a midportion of said straight spring for providing a fulcrum for said straight spring and means for raising said distal end of said straight spring to provide a lifting force for said user and a user harness operatively associated with said straight spring.

2. The apparatus of claim 1 comprising a pair of said straight springs pivotably extending from said frame and having distal ends spaced apart from each other, said fluid-operated lifting means being operable for raising said distal ends of said straight springs to provide a lifting force for said user.

3. The apparatus of claim 2 wherein said straight springs are leaf springs.

4. The apparatus of claim 2 wherein said fluid-operated means is a compressed air lifting means.

5. The apparatus of claim 2 wherein said fluid-operated lifting means comprises:

a fluid-operated ram; and a regulated pressure tank, wherein, while said lifting force is being provided, said fluid-operated ram is maintained in fluid communication with said regulated pressure tank.

6. The apparatus of claim 5 wherein said fluid-operated lifting means further comprises:

a high pressure supply tank;

conduit means for conducting an operating fluid from said high pressure supply tank to said regulated pressure tank; and a regulator for selectively regulating flow from said high pressure supply tank to said regulated pressure tank to provide a regulated lifting pressure in said regulated pressure tank.

7. The apparatus of claim 6 wherein said fluid-operated lifting means further comprises:

an air compressor and second conduit means for conducting air from said air compressor to said high pressure supply tank.

8. The apparatus of claim 2 further comprising:

said harness positionable on said user and having a pair of shoulder straps and a pair of lift lines attachable between said shoulder straps and said distal ends of said straight springs.

9. The apparatus of claim 2 further comprising:

a yoke secured between said distal ends of said straight springs; and a lift line suspended from said yoke.

* * * * *

UNITED STATES PATENT AND TRADEMARK OFFICE

CERTIFICATE OF CORRECTION

PATENT NO. : 6,273,844 B1
DATED : August 14, 2001
INVENTOR(S) : Kelsey et al.

It is certified that error appears in the above-identified patent and that said Letters Patent is hereby corrected as shown below:

Column 7,
Line 1, the word "means" should be inserted between the words "lifting" and "movably".

Signed and Sealed this

Ninth Day of July, 2002

*Attest:*

*Attesting Officer*

JAMES E. ROGAN
*Director of the United States Patent and Trademark Office*